US005393487A

United States Patent [19]

Matway et al.

[11] Patent Number: 5,393,487

[45] Date of Patent: Feb. 28, 1995

[54] STEEL ALLOY HAVING IMPROVED CREEP STRENGTH

[75] Inventors: Roy J. Matway; Michael F. McGuire; Jay Mehta, all of Pittsburgh, Pa.

[73] Assignee: J & L Specialty Products Corporation, Pittsburgh, Pa.

[21] Appl. No.: 107,275

[22] Filed: Aug. 17, 1993

[51] Int. Cl.[6] ..... C22C 38/48

[52] U.S. Cl. ..... 420/43; 420/51; 420/54

[58] Field of Search ..... 420/43, 51, 54

[56] References Cited

U.S. PATENT DOCUMENTS

| | | | |
|---|---|---|---|
| Re. 29,313 | 7/1977 | Muta et al. | 75/128 A |
| 2,750,283 | 6/1956 | Loveless | 75/124 |
| 3,362,813 | 1/1968 | Ziolkowski | 75/128 |
| 3,563,729 | 2/1971 | Kovach et al. | 75/128 |
| 3,650,709 | 3/1972 | Morsing | 29/196.1 |
| 3,678,920 | 3/1972 | Cohen et al. | 126/344 |
| 3,716,354 | 2/1973 | Reen | 75/128 W |
| 3,837,846 | 9/1974 | Becker et al. | 75/124 |
| 3,854,937 | 12/1974 | Muta et al. | 75/128 N |
| 3,900,316 | 8/1975 | Jones | 75/128 A |
| 3,929,473 | 12/1975 | Streicher | 75/128 W |
| 3,969,109 | 7/1976 | Tanczyn | 75/128 N |
| 3,989,514 | 11/1976 | Fujioka et al. | 75/124 |
| 4,007,038 | 3/1977 | Deverell | 75/122 |
| 4,086,107 | 4/1978 | Tanino et al. | 148/136 |
| 4,102,677 | 7/1978 | Deverell | 75/128 |
| 4,108,641 | 8/1978 | Fujioka et al. | 75/124 |
| 4,119,765 | 10/1978 | Pinnow et al. | 428/683 |
| 4,127,428 | 12/1978 | Izumiyama et al. | 148/38 |
| 4,141,762 | 2/1979 | Yamaguchi et al. | 148/37 |
| 4,155,752 | 5/1979 | Oppenheim et al. | 75/124 |
| 4,162,930 | 7/1979 | Abe et al. | 148/38 |
| 4,216,013 | 8/1980 | Gemmel et al. | 75/125 |
| 4,244,062 | 9/1980 | Darnfors | 75/128 E |
| 4,255,497 | 3/1981 | Bond et al. | 428/685 |
| 4,341,555 | 7/1982 | Douthett et al. | 75/128 A |
| 4,456,482 | 6/1984 | Nichol et al. | 75/126 C |
| 4,530,720 | 7/1985 | Moroishi et al. | 75/128 A |
| 4,610,437 | 9/1986 | Baudis et al. | 266/275 |
| 4,640,817 | 2/1987 | Kajimura et al. | 420/50 |
| 4,675,156 | 6/1987 | Sakamoto et al. | 420/34 |
| 4,999,159 | 3/1991 | Uematsu et al. | 420/53 |
| 5,021,215 | 6/1991 | Sawaragi et al. | 420/584.1 |
| 5,087,414 | 2/1992 | Maniar | 420/43 |

FOREIGN PATENT DOCUMENTS

| | | |
|---|---|---|
| 52-143912 | 11/1970 | Japan . |
| 51-75614 | 6/1976 | Japan . |
| 53-33916 | 10/1976 | Japan . |
| 52-7317 | 1/1977 | Japan . |
| 52-7318 | 1/1977 | Japan . |
| 52-13441 | 2/1977 | Japan . |
| 52-119411 | 10/1977 | Japan . |
| 52-138420 | 11/1977 | Japan . |

OTHER PUBLICATIONS

V. Vyklicky et al., "Anderungen in der Verteilung des Schwefelgehaltes in hochlegierten hitzebestandigen Stahlen nach der Oxidation", 22 J. Heft, 1971, pp. 403–408.

R. Wild, "High Temperature Oxidation of Austentic Stainless Steel in Low Oxygen Pressure", Corrosion Science, 1977, vol. 17, pp. 87–104.

C. Sellars and W. Tegart, "Hot Workability", International Metallurgical Reviews, The Institute of Metals, 1972, pp. 1–24.

(List continued on next page.)

*Primary Examiner*—Deborah Yee

*Attorney, Agent, or Firm*—Buchanan Ingersoll; Michael L. Dever

[57] ABSTRACT

An austenitic steel alloy is provided having improved creep strength at high temperature. The improved creep strength performance is achieved by adding a limited amount of silicon to the steel alloy along with increased amounts of nitrogen and columbium, also known as niobium. The added columbium ties up the carbon in the alloy composition to prevent sensitization promotion and premature corrosion-fatigue failures. The resulting steel alloy provides improved strength, improved carburization resistance, and maintains good weldability.

5 Claims, 1 Drawing Sheet

OTHER PUBLICATIONS

S. Ekerot, "The Behaviour of Silicate Inclusions in Steel during Hot Working", Scandinavian Journal of Metallurgy 3, 1974, pp. 21–27.

W. Tegart, "The Role of Ductility in Hot Working", Ductility, Ohio, ASM, 1968, pp. 133—177.

S. Ekerot, "Behaviour of Slag Inclusions of Different Composition during Hot Working Conditions", Clean Steel, vol. 1, Stockholm, Royal Swedish Academy, 1970, pp. 217–227.

R. Kiessling, "The behaviour of non–metallic inclusions in wrought steel", London, Iron & Steel Institute, 1968, pp. 51–73.

STEEL ALLOY HAVING IMPROVED CREEP STRENGTH

BACKGROUND OF THE INVENTION

1. Field of the Invention

The present invention relates to an austenitic steel having improved creep strength.

2. Description of the prior art

Recent developments in the formulation of austenitic steel alloys have produced austenitic steels having desired properties such as high temperature oxidation resistance, good cold workability, weldability and high mechanical strength at ambient temperature. Research continues, however, into providing a steel alloy having improved creep strength, which is useful for steel annealing box covers which operate at temperatures around 800° C.

Recently, Avesta has developed a new alloy grade designated Avesta 253MA TM which provides improved creep strength over its prior steel alloys. This development is discussed in U.S. Pat. No. 4,224,062. Therein, an austenitic steel alloy having improved high temperature creep strength is formed by incorporating a rare earth metal, such as lanthanum and the other lanthanides, and an alkaline earth metal, such as the group 2*a* elements calcium, strontium and barium, into a fully austenitic steel. In a preferred embodiment, calcium in the amount 0.002–0,006 % by weight is used as the alkaline earth metal and cerium in the amount 0.03–0.07 % by weight is used as the rare earth metal. Even with the improved creep strength afforded by the alloy disclosed in U.S. Pat. No. 4,224,062, alloy 253MA TM provides only a marginal improvement in creep strength over existing steel alloys.

Table I below sets forth the expected average creep strain at 700° C. for 253MA TM steel alloy and 309 steel alloy, an existing austenitic steel alloy recognized as needing improved creep performance. As can be seen, even with the addition of the lanthanide rare earth metals and alkaline earth metals, the increased creep strain performance of 253MA TM steel alloy is minimal.

TABLE I

| | Creep Strain At 700° C. (MPa) | |
|---|---|---|
| | 253 MA TM | 309 |
| 1,000 hours | 74 | 70 |
| 10,000 hours | 44 | 40 |

Although the addition of a lanthanide rare earth metal performs satisfactorily in the 253MA TM alloy, the addition of a lanthanide metal lessens the weldability of certain alloy compositions. Notably, the addition of a rare earth lanthanide metal to alloy 309 results in an alloy having lessened weldability performance. Thus, there is a need for an alloy having improved creep strength which does not rely on the addition of a rare earth metal to provide that improved property.

It is also desired in a steel alloy to have improved carburization resistance. The typical approach to improve carburization resistance is to increase the amount of silicon in the steel alloy. However, the addition of silicon to most austenitic steel alloys reduces the creep strength of the alloys and worsens fusion cracking in the weldments in the alloys. Consequently, there is a need for a steel alloy having improved carburization resistance which does not rely on the addition of higher silicon content in the alloy composition.

SUMMARY OF THE INVENTION

An austenitic steel alloy is provided having improved creep strength properties without sacrificing carburization resistance and weldability performance. This improved alloy is characterized by the addition of a limited amount of silicon along with nitrogen and columbium, also known as niobium. The new steel alloy has the general composition of the 309 alloy with the silicon concentration changed to approximately 1.50 percent, the nitrogen concentration being approximately 0.15 percent, and the columbium concentration being approximately 0.40 percent. Such a steel alloy composition provides improved creep strength over the 309 alloy, maintains the weldability performance of the 309 alloy and has about three times the carburization resistance of the 309 steel alloy.

DETAILED DESCRIPTION OF THE PREFERRED EMBODIMENTS

Figure 1:
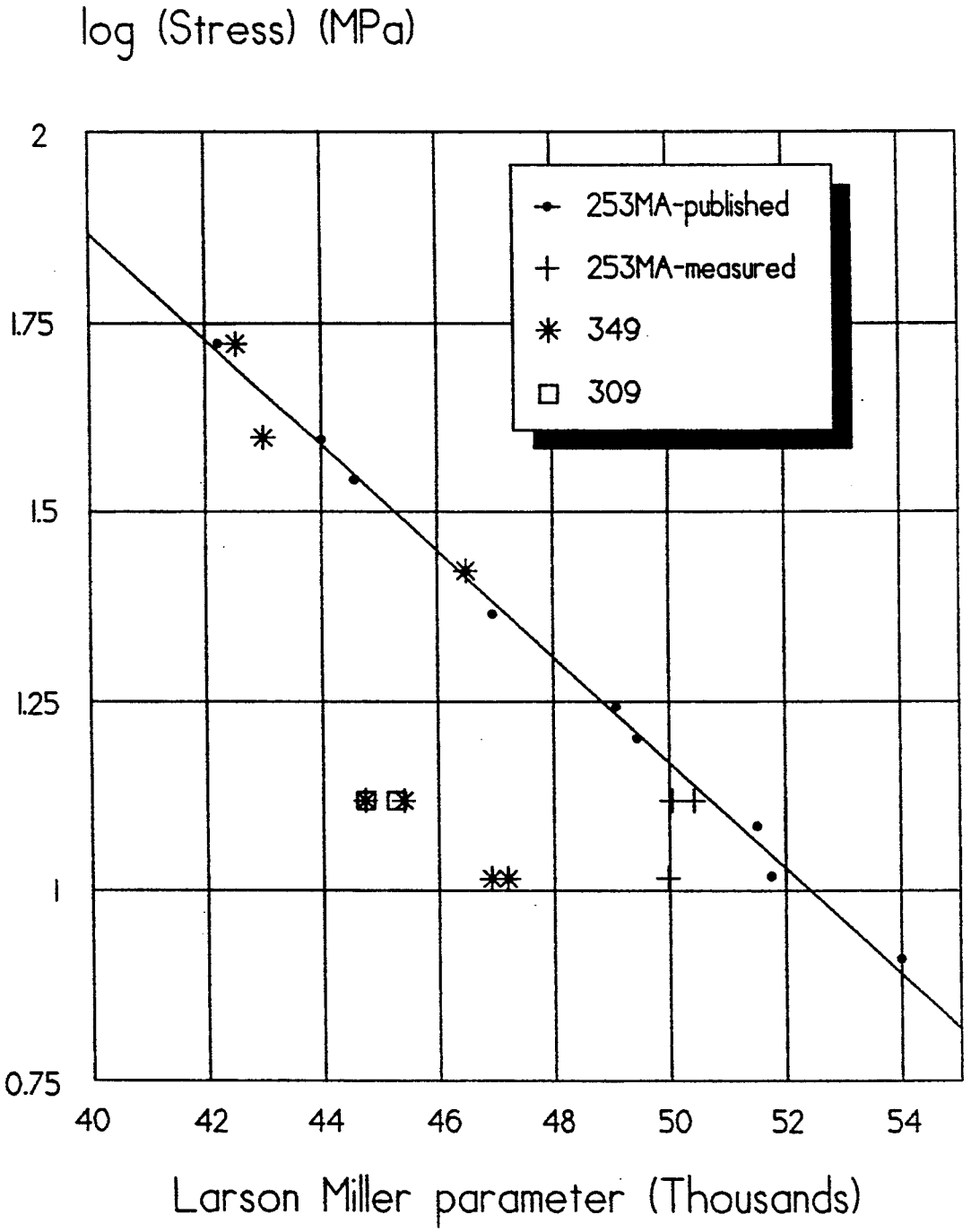
FIG. 1 is a graph showing the creep strength of the steel alloy made in accordance with the present invention compared with prior art steel alloys as a function of temperature and time.

An improved steel alloy, designated as alloy JL349 TM, is provided having enhanced creep strength performance and carburization resistance. The composition of the improved steel alloy is similar to the formulation of the 309 alloy with the addition of silicon, nitrogen and columbium. A presently preferred version of the alloy having the fellowing weight percent composition is set forth in Table II below.

TABLE II

| | | | |
|---|---|---|---|
| carbon | 0.050 | nickel | 14.55 |
| manganese | 1.55 | molybdenum | 0.50 |
| phosphorus | as low as possible | copper | 0.50 |
| sulfur | 0.001 | nitrogen | 0.15 |
| silicon | 1.50 | columbium | 0.40 |
| chromium | 23.20 | boron | 0.0015 |

The expected average creep performance of this improved alloy grade shows a creep strain of 120MPa at 700° C. for 1,000 hours and 90MPa creep strain at 700° C. for 10,000 hours. This creep performance is significantly improved compared to the estimated average creep performance of the prior art 253MA TM and 309 grade see forth in Table I above.

The presently preferred steel alloy JL349 TM has a ferrite content of 4.5 percent based on the Delong diagram. Using the WRC 1992 and WRC 1988 diagrams, the ferrite concentration of the proposed steel alloy is extrapolated to 3.5 percent.

Tests were performed on the improved steel alloy JL349 TM in accordance with the present invention as well as the prior are 309 grade alloy and 253MA TM grade alloy. Results of those tests are set forth in Table III below in which the temperature, the time for 1% creep, the creep strain, the log stress and the Larson-Miller Parameter are reported.

TABLE III

| Test | Alloy | Temp (°F.) | 1% Creep Time (sec) | Stress (MPa) | Log Stress | L-M Prm. |
|---|---|---|---|---|---|---|
| 1 | 309 | 1652 | 14.35 | 13.1 | 1.117 | 44683 |
| 2 | 309 | 1652 | 23.26 | 13.1 | 1.117 | 45126 |
| 3 | 309 | 1652 | 14.64 | 13.1 | 1.117 | 44702 |
| 4 | JL349 TM | 1292 | 19231 | 53.1 | 1.725 | 42546 |
| 5 | JL349 TM | 1292 | 34480 | 39.3 | 1.594 | 42990 |
| 8 | 253MA TM | 1652 | 5128 | 13.1 | 1.117 | 50075 |
| 10 | JL349 TM | 1472 | 12500 | 26.2 | 1.418 | 46555 |
| 11 | 253MA TM | 1652 | 7407 | 13.1 | 1.117 | 50413 |
| 12 | 253MA TM | 1652 | 4545 | 10.3 | 1.013 | 49965 |
| 13 | JL349 TM | 1652 | 227 | 10.3 | 1.013 | 47216 |
| 14 | JL349 TM | 1652 | 26.7 | 13.1 | 1.117 | 45253 |

The creep data for the 253MA TM steel alloy matches the published data for that alloy reasonably well.

The Larson-Miller Parameter is an empirical number reflecting the operating temperature and the creep strength of the alloy. The Larson-Miller Parameter is defined in accordance with the equation below:

$$L-M=(T+460)*(\log(t)+20$$

where T is the test temperature in degrees Fahrenheit and t is the time in hours for 1 percent creep to occur at the operating temperature.

Table III shows that the performance of improved steel alloy JL349 TM is superior to that of prior art steel alloy 309 through operating temperatures up to 800° C. (1472° F.). At operating temperatures above 800° C., the performance of improved steel alloy JL349 TM reverts to that of alloy 309. Thus, when used in operating conditions under 800° C., such as in an annealing box, improved steel alloy JL349 TM provides improved creep strength over prior art steel alloys.

The results of the data in Table III have been plotted in FIG. 1. FIG. 1 also includes data regarding published information concerning the 253MA TM alloy. FIG. 1 shows that the improved steel alloy JL349 TM of the present invention achieves improved creep strength.

Columbium is added to the formulation of improved steel alloy JL349 TM to tie up the carbon which is present in the alloy composition. In alloy 309 and the 253MA TM alloy, the carbon is not tied up. As a result, the carbon in these alloys promotes sensitivization and premature corrosion-fatigue failures. By the addition of columbium, improved steel alloy JL349 TM overcomes the sensitivization promotion and premature corrosion-fatigue failures of the other alloys.

The improved steel alloy JL349 TM of the present invention provides its improved creep strength performance without sacrificing carburization resistance. Table IV below presents carburization data obtained for improved steel alloy JL349 TM of the present invention, as well as alloy 309S and alloy 253MA TM. This carburization data was obtained by exposing the subject material to an endothermic atmosphere of 40% $N_2$, 21% CO, 40% $H_2$ and 1% $CH_4$ at 1700° F. for 5 cycles, 12 hours each.

TABLE IV

| Material | Condition | Weight Gain (mg/sq. in.) | % C |
|---|---|---|---|
| 309S | As received | — | .042 |
| 309S | Carburized | 6.5 | .105 |
| 309S | Carburized | 6.8 | .106 |
| 253MA TM | As received | — | .090 |
| 253MA TM | Carburized | 7.4 | .141 |
| 253MA TM | Carburized | 6.7 | .127 |
| JL349 TM | As received | — | .051 |
| JL349 TM | Carburized | 4.4 | .050 |
| JL349 TM | Carburized | 4.2 | .051 |

As the data in Table IV above demonstrates, alloy JL349 TM of the present invention shows less weight gain and less added carbon after exposure to a carburizing atmosphere than do prior art alloys.

In the foregoing specification certain preferred practices and embodiments of this invention have been set out, however, it will be understood that the invention may be otherwise embodied within the scope of the following claims.

We claim:

1. An austenitic steel, said austenitic steel having improved creep strength at temperatures below 800° C. and consisting essentially of the following alloying elements:

C:0.10%
Si:more than 1% but not greater than 2%
Mn:not greater than 3%
Cr:15–25%
Ni:10–18%
Cb:more than 0.20%, but not greater than 0.75%
N:more than 0.10%, but not greater than 0.25%
Mo:less than 1%
B:greater than 0.001%, but less than 0.0025%, the amounts of said alloying elements being adjusted to result in an austenitic microstructure, and a balance of iron and other nonessential elements and impurities.

2. An austenitic steel, said austenitic steel having improved creep strength and consisting essentially of the following alloying elements:

C:less than 0.10%
Mn:greater than 1%, but less than 2%
S:less than 0.003%
Si:greater than 1%, but less than 2%
Cr:greater than 15%, but less than 25%
Ni:greater than 10%, but less than 20%
Mo:less than 1%
Cu:less than 1%
N:greater than 0.10%, but less than 0.20%
Cb:greater than 0.20%, but less than 0.75%
B:greater than 0.001%, but less than 0.0025% the amount of said alloying elements being adjusted to result in an austenitic microstructure; and balance of iron and impurities.

3. The alloy of claim 2, wherein Cr is 20–25% and Ni is 12–16%.

4. The austenitic steel of claim 3 wherein Si is 1.25%–1.75% and Cb is 0.30%–0.50%.

5. The austenitic steel of claim 4 wherein Si is approximately 1 50% N is approximately 0.15% and Cb is approximately 0.40%.

* * * * *